US006073270A

United States Patent [19]

Schnabl

[11] Patent Number: 6,073,270

[45] Date of Patent: Jun. 13, 2000

[54] PANTS GARMENT

[76] Inventor: Katrin Schnabl, 204 W. Houston St., #1B, New York, N.Y. 10014

[21] Appl. No.: 09/087,575

[22] Filed: May 29, 1998

[51] Int. Cl.[7] ..... A41D 1/06

[52] U.S. Cl. ..... 2/237

[58] Field of Search ..... 2/237, 221, 227, 2/235, 236, 220, 234, 309, 338, 76; D2/742

[56] References Cited

U.S. PATENT DOCUMENTS

| | | | |
|---|---|---|---|
| 939,058 | 11/1909 | Morris, Jr. | 2/237 |
| 966,747 | 8/1910 | Holdgate | 2/221 |
| 1,826,803 | 10/1931 | Lubell | 2/237 |
| 2,140,221 | 12/1938 | Cornish | 2/237 |
| 2,281,872 | 5/1942 | Donnelly | 2/237 |
| 2,434,714 | 1/1948 | Newcombe | 2/237 |
| 2,661,477 | 12/1953 | Gilbertson | 2/221 |
| 5,033,125 | 7/1991 | De La Villefromoy et al. | 2/237 |
| 5,566,397 | 10/1996 | Scott | 2/237 |

FOREIGN PATENT DOCUMENTS

| | | | |
|---|---|---|---|
| 2308321 | 11/1976 | France | 2/221 |
| 172782 | 3/1952 | Germany | 2/221 |

*Primary Examiner*—Amy Vanatta
*Assistant Examiner*—B Waynes
*Attorney, Agent, or Firm*—R. Neil Sudol; Henry D. Coleman

[57] ABSTRACT

A pants garment has a generally tubular body member made of flexible web material. The tubular body member has an elongate waist or yoke edge at an upper side and a crotch area at a lower side. The tubular body member is provided with a flap section overlapping another portion of the body member. The flap section is defined in part by a boundary edge extending in a generally downward direction from the waist edge. A flexible tensile element has a first effective end coupled to the flap section at the boundary edge and a second effective end coupled to the tubular body member at a point spaced from the boundary edge. This structure enables a user or wearer to place tension on the flap to maintain closure of the garment over a lower torso of the user.

14 Claims, 1 Drawing Sheet

PANTS GARMENT

BACKGROUND OF THE INVENTION

This invention relates to a garment and particularly to a pants garment.

Pants or trousers are generally secured to the lower torso of a user by a zipper and a belt. Of course, there are well known alternative methods of closure, including, for instance, buttons and elastic bands. All of these methods of closing a waist region of a pair of pants or trousers about a waist of a user, thereby attaching the pants to the user, are relatively complex. Zippers are frequently difficult to manipulate, particularly by those afflicted with such joint diseases as arthritis. The use of zippers and belts require at least two steps to secure the pants to the user.

Belts generally limit design variation possible in designing a pair of pants. Belts extend about the upper edge of the pants, along the waist, and are usually symmetrically disposed. Zippers have been placed, particularly on women's pants, in different locations, along a side seam, or in the seat region of the pants.

OBJECTS OF THE INVENTION

An object of the present invention is to provide a pants or trousers type garment with a new closure or means for fixing the garment to a waist or lower torso region of a user.

Another object of the present invention is to provide a pants or trousers type garment with a closure or fixation device attached so as to obviate the need for a zipper closure.

A further object of the present invention is to provide a pants or trousers type garment with a closure which has a novel or aesthetic appearance.

These and other objects of the invention will be apparent from the drawings and descriptions herein.

SUMMARY OF THE INVENTION

A pants garment comprises, in accordance with the present invention, a generally tubular body member or torso section made of flexible web material. The tubular body member is oversized relative to the lower torso of a user and has an elongate waist edge at an upper side and a crotch area at a lower side. An elongate flexible tensile element has a first effective end coupled to the tubular body member or torso section at a first point and a second effective end coupled to the tubular body member at a second point spaced from the first point. This structure enables a user or wearer to place tension on the tubular body member or torso section to effectuate a closure of the body member or torso.

In a preferred embodiment of the invention, the tubular body member is provided with a flap section overlapping another portion of the body member. The flap section is defined in part by a boundary edge extending in a generally downward direction from the waist edge. The first point of connection of the flexible tensile member is to the flap section at the boundary edge.

A garment in accordance with the present invention is typically a pair of pants or trousers, with leg portions connected to the tubular body member along the lower side thereof. The leg portions extend away from the tubular torso on opposite sides of the crotch area. It is to be noted, however, that the garment may be a pair of shorts wherein the leg sections are short or even completely omitted.

A garment in accordance with the present invention facilitates the elimination of the customary zipper. The flap section overlaps the underlying portion of the torso or body member of the garment and is held in position by the flexible tensile element. The flap section may hide a slit or opening in the tubular torso member of the garment. In a preferred embodiment of the invention, however, the flap section is part of a fold in the tubular torso or body member of the garment. In that case, the waist edge may be an endless edge folded back on itself to form the fold, while the garment has no slit or other access opening in the tubular torso or body member. In this embodiment of the invention, there is no need for a zipper. Of course, a zipper or an opening may be provided, whether for aesthetic or functional response.

It is contemplated that the flexible tensile element extends less than 360° about the torso or body member. Preferably, the tensile extends less than 180° about the torso or body member. More specifically, the tensile element may be attached at one effective end to a seam of the garment, either at the center of a seat region of the tubular torso or body member, or at the side of the body member.

The term "effective end" is used herein to signify an end point in an excursion of the flexible tensile element about the tubular torso or body member of the garment and accordingly about a lower torso of the user. It is to be noted that the flexible tensile element may be looped so that the effective ends of the tensile element are at fold or loop-back points of the tensile element.

In accordance with another feature of the present invention, the boundary edge or fold line extends from the waist edge to the crotch area of the tubular torso member. Preferably, the boundary edge or fold line is located in an abdominal or front region of the tubular torso member. It is to be noted, however, that the boundary edge or fold line may, in some applications, extend only part of the distance from the waist edge to the crotch area of the garment. In addition, it may be advantageous, if only from an aesthetic point of view, to provide the flap section or fold in a different location on the tubular torso member, for example, along a side of the garment.

Generally, it is contemplated that the flap section or fold is triangular.

In a preferred embodiment of the present invention, the tensile element is a belt. The belt exemplarily includes a first belt part connected to the flap section at the boundary edge and a second belt part connected to the tubular body member at the point spaced from the boundary edge. The belt parts are connected to one another by a buckle or other adjustable coupling device. Instead of two belt parts, the flexible tensile element may take the form of a single belt segment which is fastened at one end to the tubular torso member and which is passed through a loop connected to the boundary edge of fold line.

The flexible tensile element may alternatively take the form of a cord, rope, wire, cable, or chain having one or two continuous segments.

A pants garment in accordance with the present invention may take the form of sportswear or activewear. The asymmetrical disposition of the flexible tensile element provides the garment with a distinct aesthetic appeal.

DESCRIPTION OF THE PREFERRED EMBODIMENTS

Figure 1:
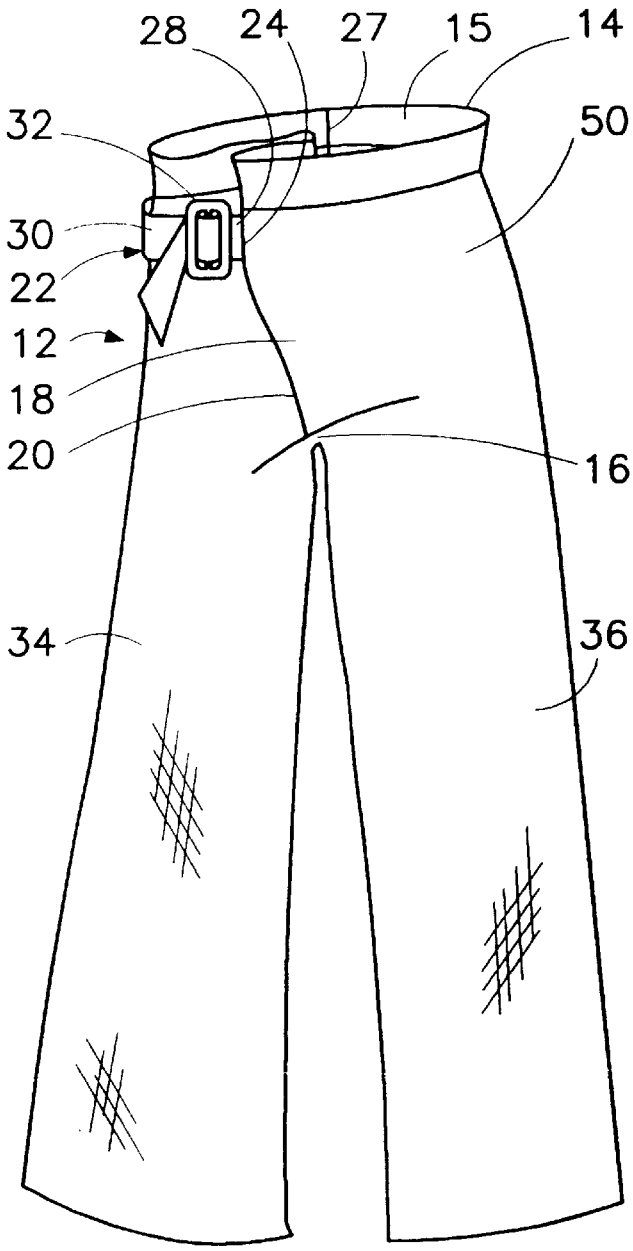
FIG. 1 is a schematic front elevational view of a pair of pants in accordance with the present invention.

As illustrated in the drawing, a pants garment comprises a generally tubular torso or body member 12 made of flexible web material such as a woven fabric. Body member 12 has a front side 50 which covers an abdomen of a user and a rear side 52 which covers a seat region of the user.

Body member 12 is provided at an upper side with an endless yoke 15 having a continuous or uninterrupted waist edge 14 and is formed at a lower side with a crotch area 16. Body member 12 is further provided with a substantially triangular flap section 18 overlapping another substantially triangular portion (not separately labeled) of the body member. Flap section 18 is defined in part by a boundary edge 20 which extends in a generally downward direction from waist edge 14. Another side of flap section 18 is formed by waist edge 14.

The pants garment further comprises a flexible tensile element 22 having a first effective end 24 coupled to the flap section 18 at boundary edge 20 and a second effective end 26 coupled to body member 12 at a point (not designated) spaced from boundary edge 20. By adjusting tensile element 22, a user or wearer is able place a desired amount of tension on flap section 18 to maintain closure of the garment over a lower torso of the user.

Tensile element 22 takes the form of a belt having a first part 28 fastened at end 24 to boundary edge 20 and a second part 30 fastened at end 26 to tubular torso member 12. A buckle or other adjustable locking element 32 is attached to one of the belt parts 28 and 30 for releasably coupling parts 28 and 30 to one another, thereby holding flap section 18 in a stretched configuration across the underlying portion of tubular torso member 12.

Effective ends 24 and 26 represent limit points of tensile element or belt 22 along a circumference or perimeter of tubular torso member 12. Tensile element or belt 22 extends along the circumference only between ends 24 and 26. Where two-part belt 22 is replaced by a single segment, the single segment loops back on itself at one end point 24 or 26.

The garment includes a pair of pants legs 34 and 36 connected to tubular torso member 12 along the lower side thereof Legs 34 and 36 extend away from tubular torso member 12 on opposite sides of crotch area 16.

Flap section 18 is an overlying part of a triangular fold (not separated labeled) in tubular torso member 12 Thus, boundary edge 20 is a fold line of the triangular fold. Boundary edge or fold line 20 extends from crotch area 16 to waist edge 14. Waist edge 14 is continuous, uninterrupted, and endless in extent while tubular torso member 12 is continuous and imperforate. Torso member 12 is not provided with any zipper opening or slit. To perform bodily functions, the user loosens belt 22, at least partially unfolds flap section or fold 18, thereby enlarging the waist of the garment, and removes the garment from the torso.

A garment has described herein with reference to the drawing facilitates the elimination of the customary zipper. Flap section or fold 18 overlaps the underlying portion of torso member 12 and is held in position by belt 22.

Tensile element of belt 22 extends less than 360° about torso or body member 12. Preferably, belt 22 extends less than 180° about torso or body member 12. More specifically, belt part 30 is attached at end 26 to a seam 27 on the seat region of the garment. Of course, belt part 30 may be alternatively attached at a side seam (not shown) or other location on body member 12.

Figure 2:
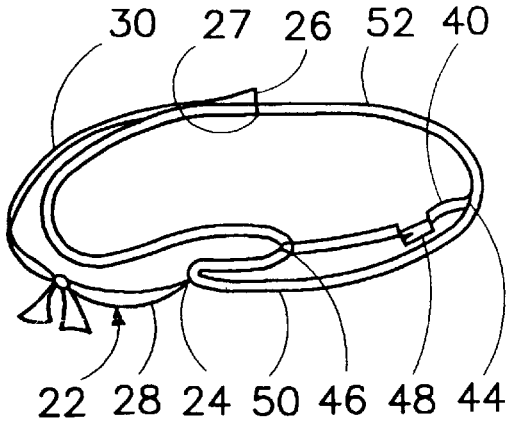
FIG. 2 is a schematic top view of the pants of FIG. 1.

In donning the pants of FIGS. 1 and 2, the user loosens belt 22 (if not already loose or unbuckled), pulls on the pants, folds the excess material constituting flap section or fold 18 in strong-fashion, and tightens belt 22 to secure the fold. As shown in FIG. 2, a strap or other elongate tensile element 40 may be provided inside tubular body member 12 for maintaining flap section or fold 18 in an overlapping configuration. Strap 40 is connected at one end 44 to a side seam of the pants and at the other end to an inside fold line or edge 46. A buckle or clamp 48 may be provided for enabling an adjustment in tension.

It is to be noted that, depending on the particular method of use, that flap section or fold 18 may be effectively eliminated by bunching or ruffling of the material of tubular section 12 in an area on the same side of fold line 20 as belt 22.

Although the invention has been described in terms of particular embodiments and application, it is to be understood that modifications and improvements may be made without departing from the spirit of or stepping outside the scope of the present invention. For example, it is to be noted that the garment may be a pair of shorts wherein legs 34 and 36 are short or even completely omitted. In addition, flap section or fold 18 may hide a slit or opening in the tubular torso member 12 of the garment.

It is to be understood also that the boundary edge or fold line 20 may, in some applications, extend only part of the distance from waist edge 14 to crotch area 16 of the garment. It may be advantageous to provide flap section or fold 18 in a different location on the tubular torso member, for example, along a side of the garment.

Tensile element of belt 18 may be replaced by a cord, rope, wire, cable, or chain having one or two continuous segments.

Accordingly, the drawings and descriptions herein are preferred to illustrate and explain the invention and are not intended to limit the scope thereof.

What is claimed is:

1. A pants garment comprising:

a generally tubular body member made of flexible web material, said tubular body member having an elongate substantially oversized continuous or endless waist or yoke edge at an upper side and a crotch area at a lower side, said tubular body member having a substantially continuous or endless fold of material disposed assymetrically to one side of a center line between said waist or yoke edge and said crotch area, said fold of material extending from said crotch area to said waist or yoke edge, said tubular body member being free of folds extending from said crotch area to said waist or yoke edge on an opposite side of said center line; and an elongate flexible tensile element having a first effective end and a second effective end, said first effective end being coupled to said tubular body member at a first point along a fold line of said fold of material and said second effective end being coupled to said tubular body member at a second point spaced from said first point, thereby enabling a placing of tension on said fold of material to maintain closure of said tubular body member over a lower torso of a user, said flexible tensile element being disposed only to said one side of said center line, said tubular body member being free of garment closure fasteners on said opposite side of said center line.

2. The pants garment defined in claim 1 wherein said fold line extends from said crotch area to said waist or yoke edge.

3. The pants garment defined in claim 1 wherein said fold of material is triangular, said fold line defining one edge or boundary of said fold of material.

4. The pants garment defined in claim 1 wherein said tensile element is a belt.

5. The pants garment defined in claim 4 wherein said belt includes a first belt part connected to said tubular body member at said first point and a second belt part connected to said tubular body member at said second point.

6. The pants garment defined in claim 1 wherein said tubular body member has a circumference, said first point being located less than one-half of said circumference from said second point.

7. The pants garment defined in claim 1, further comprising a pair of pants legs attached to said tubular body member at said lower side thereof.

8. The pants garment defined in claim 1 wherein said first point and said second point are spaced from said waist or yoke edge and said crotch area.

9. A garment comprising:

two tubular pants legs;

a torso section connected on a lower side to said pants legs and defined along an upper side by an endless waist or yoke edge, said torso section and said pants legs defining a crotch, said torso section being continuous or imperforate and substantially oversized relative to a user's lower torso; and an elongate flexible tensile member having a first effective end and a second effective end spaced from one another, said first effective end being coupled to said torso section at a first point and said second effective end being coupled to said torso section at a second point spaced from said first point, for exerting tension on said torso section to tighten said torso section about a lower torso of a user, said tensile member being disposed assymetrically on one side of a center line extending between said waist or yoke edge and said crotch, said torso section being free of garment tightening fasteners on an opposite side of said center line.

10. The garment defined in claim 9 wherein said torso section is folded over itself to form an area of overlap having a boundary edge extending from said crotch to said waist or yoke edge, said first point being disposed along a fold line or edge of said area of overlap.

11. The garment defined in claim 10 wherein said torso section has a seat portion and an abdominal portion, said abdominal portion being folded over itself to form said area of overlap.

12. The garment defined in claim 9 wherein said torso section has a circumference, said first point being spaced from said second point less than one-half of said circumference.

13. A garment comprising a torso section with a continuous or endless waist or yoke edge and a crotch, an elongate flexible tensile member being connected at effectively opposite ends to said torso section at points spaced from one another along a circumference of said torso section so that said flexible tensile member extends only partially along said circumference, said tensile member being disposed assymetrically on one side only of a center line extending between said waist or yoke edge and said crotch.

14. The garment defined in claim 13 wherein:

said torso section has a seat portion and an abdominal portion;

said abdominal portion is folded over itself to form an area of overlap;

said waist or yoke edge is endless and oversized relative to the user's waist; and said first point is located along a fold line of said torso section, said fold line defining a boundary edge of said area of overlap.

* * * * *